United States Patent [19]

Vackier

[11] Patent Number: 4,770,967

[45] Date of Patent: Sep. 13, 1988

[54] METHOD AND APPARATUS FOR THE DEVELOPMENT OF AN ELECTROSTATIC CHARGE IMAGE

[75] Inventor: Leo N. Vackier, 's-Gravenwezel, Belgium

[73] Assignee: Agfa-Gevaert N.V., Mortsel, Belgium

[21] Appl. No.: 44,418

[22] Filed: Apr. 30, 1987

[30] Foreign Application Priority Data

May 15, 1986 [EP] European Pat. Off. ..... 86200841.4

[51] Int. Cl.[4] ..... G03G 13/06

[52] U.S. Cl. ..... 430/102; 430/117; 430/119; 118/659; 118/661

[58] Field of Search ..... 430/102, 117, 119

[56] References Cited

U.S. PATENT DOCUMENTS 3,216,844 11/1965 King ..... 430/102 X 3,888,666 6/1975 Matsumoto et al. ..... 430/117 X

OTHER PUBLICATIONS

Damm, "Non-Clogging Ink-Jet Printer", IBM Tech. Discl. Bull., vol. 15, No. 4, Sep. 1972, p. 1191.

Damm, "Non-Impact Printing Method", IBM Tech. Discl. Bull., vol. 15, No. 9, Feb. 1973, p. 2389.

*Primary Examiner*—Roland E. Martin

*Attorney, Agent, or Firm*—William J. Daniel

[57] ABSTRACT

A method and apparatus for the development of an electrostatic image on a recording surface by supplying liquid developer comprising positively or negatively charged toner particles dispersed in an electrically insulating non-polar carrier liquid to a developing zone where increments of the electrostatic image are successively developed by attraction or toner particles to a recording layer, e.g., photoconductive coating (3), in a distribution depending on the distribution of charges forming said electrostatic image, wherein the liquid developer is supplied, e.g. with ink-jet (7), to the developing zone so that in course of the period over which the development of the complete electrostatic image takes place, said developer is made available at that zone in a distribution pattern which constitutes a lower resolution version of the electrostatic image to be developed, each increment of said pattern being brought directly opposite the corresponding increment of the electrostatic image.

9 Claims, 3 Drawing Sheets

METHOD AND APPARATUS FOR THE DEVELOPMENT OF AN ELECTROSTATIC CHARGE IMAGE

DESCRIPTION

The present invention relates to a method of developing electrostatic and to apparatus therefor.

A survey of different methods for the production of electrostatic images on photoconductive electrically insulating recording materials and on non-photoconductive electrically insulating recording materials is given e.g. in U.S. Pat. No. 4,130,670.

The development of electrostatic images is usually effected by the deposition of finely divided coloured particulate material, called toner particles. The toner particles have a definite electric charge sign and are attracted by charges of opposite sign in proportion to their strength.

The deposited toner particles can be fixed, e.g. by heating or other suitable means, on the surface on which they are initially image-wise deposited or they can be transferred to another supporting medium, e.g. paper, and then fixed.

The development can be effected with a dry or wet developer. A dry deveoper comprises charged toner particles in admixture with carrier particles. Wet developers can be constituted solely by a liquid but more usually they are so-called electrophoretic developers comprising a suspension of charged toner particles in an insulating carrier liquid. The present invention provides an improved development method using a liquid developer of this electrophoretic type.

When using an electrophoretic developer the suspended electrically charged toner particles migrate through the carrier liquid under the influence of an electric field generated by or in dependence on the electrostatic charge image to be developed, a phenomenon known as electrophoresis. In positive-positive development toner particles migrate and deposit on those areas of the charge carrying surface (hereafter called "recording surface") which are in positive-positive realtion to the oiginal image to be developed. In the case that the recording surface is the surface of a photoconductor which has been overall charged and then image-wise exposed, these areas are those which were unexposed and therefore carry retained charges. In reversal development, toner particles migrate and deposit on recording surface-areas which are in positive-negative relation to the original image. In the case that those areas are areas of a photoconductor which were discharged by exposure, the particles deposit responsive to charges created in those areas by fringe effect or by induction by means of a developing electrode. (Ref: R. M. Schaffert "Electrophotography" The Focal Press—London New York. Enlarged and Revised Edition 1975. pp. 50–51, and T. P. Maclean "Electronic Imaging" Academic Press—London 1979 p. 231).

Electrophoretic development is usually accomplished by flowing the liquid developer over the recording surface. According to another known method, the liquid developer is applied to the recording surface from an applicator roller by a so-called meniscus coating technique in which a liquid bead is formed between said roller and the recording surface. Yet another approach is to move the recording surface through a supply of the electrophoretic developer held in a container and then to smooth the liquid layer on that surface with a downstream doctor blade or roller.

It is also known to form images from photoelectrophoretic dispersion, comprising photoconductive toner particles in a carrier liquid, by carrying a layer of the dispersion on the surface of an applicator roller to an imaging zone at which the layer is progressively image-wise irradiated while subjected to the influence of an electric field, to cause image-wise transfer of dispersion from that layer onto a contacting receiving roller (ref: U.S. Pat. No. 4,357,096) .

In the foregoing methods the recording surface on which the toner image is formed is overall contacted by and wetted with the developer dispersion. It is usually desirable to transfer the toner image from that surface to a separate receiving material in sheet form, e.g. a paper sheet. Carrier liquid, which is normally a hydrocarbon liquid, becomes adsorbed and/or absorbed by the receiving sheet both in the areas occupied by the toner image and in the background areas and eventually evaporates. The consumption of liquid therefore tends to be rather high. likewise environmental pollution.

Another disadvantage associated with the methods above referred to is the marked tendency for image quality to be impaired by fog, caused by the adhesion of toner particles to the recording surface in non-image or background areas. This tendency can be countered by imposing an appropriate bias voltage. However the imposition of such a biasing voltage tends to reduce the density of the toner image forming on the recording surface.

United Kingdom patent application No. 2 041 790A describes an electrophoretic development method in which a film of liquid developer is carried on the surface of a carrier roller to a developing zone where the liquid film passes close to but out of contact with the surface of a recording drum bearing the electrostatic image to be developed. The conductivity of the liquid and the thickness of the film are controlled so that small quanta of the liquid developer jump from the liquid developer film onto the surface of the recording drum in dependence on the electric field distribution representing the latent electrostatic image. After the quanta of liquid developer have arrived on the recording surface electrophoresis continues at a rate which is increased by the imposition of an electric field of the same polarity as the charge of the latent electrostatic image. It is indicated that this method can be used in plain paper copying machines and enables substantially dry copies to be formed because the entire surface of the photoconductor is not wetted with the liquid developer. However the method involves various operating parameters which require to be accurately controlled. The thickness of the liquid developer film and the gap between this film and the recording surface are in particular quite critical, and their control raises problems if apparatus costs are to be kept within reasonable limits.

Another method of electrophoretic development wherein care is taken to avoid appreciable wetting of the electrostatic latent image-bearing recording surface by the carrier liquid of the developer is described in U.S. Pat. No. 4,021,586. In this method the developer is applied from an applicator roller while an electric field is generated by means of a corona to induce liquid movement away from the recording surface at the point where toner transfer to that surface takes place. This method is not conducive to the production of high density images which are free from fog.

It is an object of the present invention to provide a method of developing electrostatic latent images which enables substantially fog-free toner images of a high density to be more easily obtained.

According to the present invention there is provided a method of developing an electrostatic image on a recording surface by supplying liquid developer comprising positively or negatively charged toner particles dispersed in an electrically insulating non-polar carrier liquid to a developing zone where increments of the electrostatic image are successively developed by attraction of toner particles to the recording surface in a distribution depending on the distribution of charges forming said electrostatic image, characterised in that the liquid developer is supplied to the developing zone so that in course of the period over which the development of the complete electrostatic image takes place, said developer is made available at that zone in a distribution pattern which constitutes a lower resolution version of the electrostatic image to be developed, each increment of said pattern being brought directly opposite the corresponding increment of the electrostatic image. In other words, the liquid developer is made available at the development zone in a distribution such that it forms a preliminary image congruent with but coarser than the electrostatic image (final image) to be developed and at the development zone the preliminary image provides fringes of developer extending outwardly of the projected boundary lines of the said final image.

When using a method according to the invention high density toner images can be formed with clean image background. A biasing voltage can be applied, if in any given case it should be required, in order to prevent fog in the fringe areas.

The method is very suitable for example for producing high quality toner-developed electrostatic screened (half-tone) images.

As will hereafter be shown, the method can be performed for producing transfer images on paper or other receptor sheets in such a way that there is little wastage of the carrier liquid.

In a first type of method according to the invention, liquid developer is dispensed from one or more dispensing nozzles in the distribution pattern required at the development zone. When such a method is performed repeatedly for developing a succession of electrostatic images, a fresh supply of developer is made available for developing each such image. Problems of developer deterioration as occur in tray development procedures are avoided.

The liquid developer can be dispensed from one or more nozzles in dependence on sequential electrical signals dictated by digital information representing elementary parts (pixels) of the lower resolution version of the electrostatic image to be developed.

In the performance of a method of this first type, electrcal signals for controlling the dispensing of the liquid developer can for example be derived by signal strength modulation in dependence on digital data resulting from an analog-to-digital conversion of signals obtained from a photodetector during a scanning operation wherein light reflected from or transmitted by a graphic original represented by the electrostatic image to be developed is received by such photodetector.

According to another procedure, said control signals can be derived by signal strength modulation in dependence on digital data stemming from a character generator coupled to a computer or word processor.

In such a procedure the electrostatic image can for example be obtained by character generated laser-beam exposure or LED-exposure of a previously overall charged photoconductive surface. LED stands for light emitting diode.

An optical printer using modulated LED array exposure is described e.g. in Proceedings of the SIS. Vol. 23/2, (1982) pp. 81–84 and in U.S. Pat. No. 4,435,064. Exposure apparatus with modulated laser beam are describes in "Laser Printing: The Fundamentals" by William White, Jr.; Ph.D.—Carnegie Press Inc. Madison, N.J. (1983). For a further survey of laser printers reference is made to Reza Kenkyu, 12 (1984). Nr. 9. pp. 478–498 (Chem. Abstr. 102 (1985), ref. 122935). Character generation is described by J. H. Wood in The BKSTS Journal (Part I) March 1983, pp. 84–91 and (Part II) April 1983, pp. 148–153.

In the performance of a method of the above mentioned first type in which liquid developer is dispensed from one or more nozzles in dependence on electrical control signals, the or each nozzle and the associate control means can be of a kind as used in ink-jet printers, e.g. those which operate on the continuous deflected drop principle or those using impulse jets.

A survey of ink-jet printers is given in Neblette's Handbook of Photography and Reprography, 7th edn., edited by John M. Sturge—Van Nostrand Reinhold Company—New York (1977) pp. 418–423 and further by I.Gerald Doane in Journal of Applied Photographic Engineering, Vol. 7, No. 5 October 1981, pp. 121–125, in the Journal "Physik in unserer Zeit" by Jochen Fricke "Schreiben mit Tinten-Jets", 11. Jahrg. 1980 Nr. 2, pp. 33–35 and by Elaine Pullen und Manfred Stolzenburg in "Druck Print" 1 (1982), pp. 22–24 and 28. A device having capillary liquid dispensing nozzles is described in U.S. Pat. No. 3,052,213.

When using an ink-jet principle the developer can for example be a so-called ferrofluid wherein a ferromagnetic pigment forms the toner particles and the discharge of the developer can be controlled by a liquid drop deflection system using a deflection magnet as described in the above article of Jochen Fricke, pp. 34–35.

In methods of a second type according to the invention, liquid developer is made available at the development zone in the required distribution pattern by applying liquid developer to an insulating carrier surface in the distribution pattern in which it is to be made available at the development zone, and then bringing the resulting applied developer pattern progressively to the development zone for developing the higher resolution electrostatic image on the recording surface.

In certain methods of the aforesaid second type according to the invention, the said insulating carrier surface and the recording surface are surfaces of first and second photoconductive members on which an electrostatic charge pattern (corresponding with said required developer distribution pattern) and the required higher resolution electrostatic image are respectively formed, in each case by overall electrostatically charging the member and then exposing it to a light image of the appropriate resolution; the lower resolution electrostatic charge pattern is developed by means of the liquid developer thereby to form a corresponding pattern of liquid developer on said first photoconductive member; the first and second photoconductive members are displaced so as to bring such liquid developer pattern and the higher resolution electrostatic image progressively and in appropriate register to the development zone, and liquid developer is caused to transfer from the first to the second photoconductive member at that zone to develop the higher resolution electrostatic image.

In other methods of the aforesaid second type, instead of forming the preliminary charge pattern on a photoconductive member as just described, such charge pattern is formed on a dielectric non-photoconductive member by means of (an) image-wise modulated ion stream(s) or (a) charge-modulated conductor(s). The charge pattern formed on the said dielectric member is then developed to form a corresponding pattern of liquid developer on said dielectric member, and this liquid developer pattern is made progressively available at the development zone for developing the higher resolution electrostatic image formed on a photoconductive member as in the previously described procedure. A charge pattern can be formed by means of an image-wise modulated ion stream using an aperture controlled ion projection technique as described e.g. in the above mentioned book by R. M. Schaffert at page 208 and in the book "Electrostatics and its Applications" by A. D. Moore—John Wiley & Sons, New York (198), pp. 321–323. When using charge-modulated conductor(s) the charge pattern can be conferred on the dielectric member while the conductor(s) is (are) in contact with or in close proximity to but out of contact with such member. Electrostatic printing based on image-wise charging of dielectric material by means of electrically modulated conductor pins is described e.g. by U. Rothgordt, in Philips techn. T. 36, Nr. 4 (1976), pp 94–108 and in the said book by A. D. Moore, on pp. 323–328.

In methods of the second type, the preliminary liquid developer pattern can be brought, at the development zone, into contact with the recording surface carrying the higher resolution electrostatic image. However such contacts not essential. If sufficiently strong electrical field forces act at the development zone, it suffices to bring said preliminary liquid developer pattern into close proximity with said recording surface.

Methods of the second type can of course be performed repetitively using apparatus which comprises rotatable electrostatically chargeable members and incorporates cleaning facilities for removing residual liquid developer material and unwanted electrostatic charges for such members in each cycle. Residual electrostatic charges can be removed by exposure of the said members to an alternating current corona discharge (in combination with exposure to light in the case of a photoconductive member). Residual liquid developer can be removed by means of an absorbent cleaning web.

In any method according to the present invention, developer can be image-wise transferred from the recording surface to a receptor element, e.g. of paper, to form thereon a transfer image. However it is within the scope of the invention to form and develop the higher resolution electrostatic image on a recording surface formed on sheet material, e.g. in the form of a web for one-time use. In this case the developer image is fixed on the recording surface on which it is formed and no transfer is required.

The invention includes apparatus for forming and developing an electrostatic image on a recording surface provided by an electrically insulating member, e.g. a photoconductive member, wherein there is developer applicator means for bringing liquid developer material comprising positively or negatively charged toner particles dispersed in an electrically insulating non-polar carrier liquid to a developing zone where increments of an electrostatic image on said recording surface are successively developed by attraction of toner particles to such surface in a distribution depending on the distribution of charges forming said electrostatic image, characterised in that said applicator means is operatable so as, over the period during which development of the complete electrostatic image takes place, to make said liquid developer available at said development zone in a distribution pattern which constitutes a lower resolution version of the electrostatic image to be developed, each increment of said pattern being directly opposite the corresponding increment of the electrostatic image.

The apparatus can incorporate any features, e.g. ink-jet nozzles, required for performing a method according to the invention according to any of its types or embodments hereinbefore described.

Certain embodiments of the nvention, selected by way of example, will now be described with reference to the accompanying diagrammatic drawings, in which.

Figure 1:
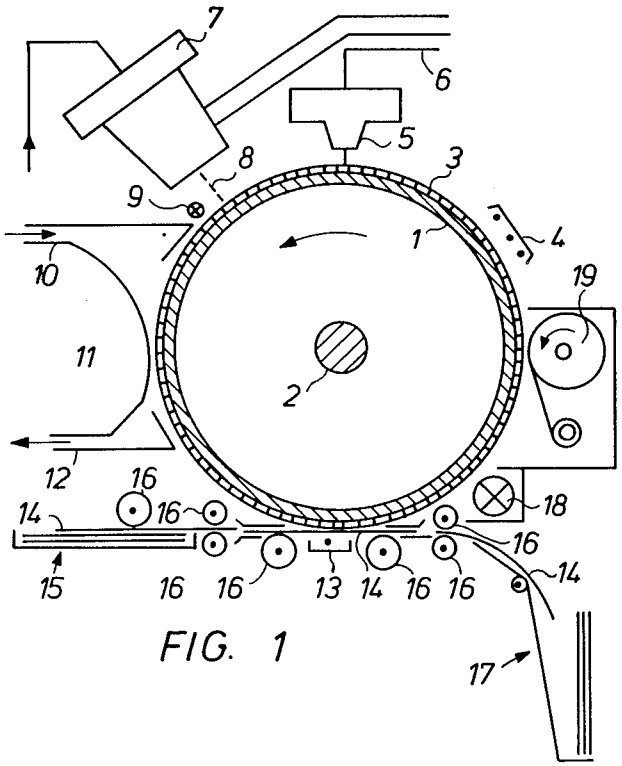
FIG. 1 is a cross-sectional elevation of an apparatus according to the present invention, wherein electrophoretic developer is applied at the development zone by means of an ink-jet device.

The apparatus illustrated in FIG. 1 comprises as liquid applicator means one or more nozzles which dispense the liquid developer in a distribution pattern corresponding to a lower resolution version of the electrostatic image to be developed. The dispensing of liquid by said nozzles is controlled by sequential electrical signals that are modulated in strength in dependence on digitized information representing elementary picture parts (pixel) of the lower resolution pattern.

In FIG. 1 element 1 represents a conductive drum rotationally driven by its shaft 2. On said drum 1, made e.g. from aluminium, a photoconductive coating 3, e.g. made of vapour-deposited photoconductive selenium or selenium alloy is present. In a first step the photoconductive layer 3 is overall charged electrostatically with the direct current corona unit 4. Following the corona charging the photoconductive layer 3 is scanning-wise exposed by means of an array 5 of LED elements of which the light-output is controlled by digital signals fed to the array by input line 6 which is connected to the signal output of a character generator (not shown in the drawing). The photoconductive layer 3 in moving past the LED array 5 is irradiated by tiny light spots corresponding with the light-emissions from the indivldually modulated LED elements in the array 5. The layer 3 is in that way discharged pattern-wise at a resolution of 16 lines per mm.

From the ink-jet device 7 a series of liquid developer drops B is projected onto the surface (recording surface) of the pattern-wise discharged photoconductive layer 3 at a development zone. The ink-jet operates according to a known principle involving piezo-electric deformation of individual ink-jet channels arranged in a row as described e.g. in "Druck Print" 1 (1981). p. 24. The piezo-electric crystals are activated by electronic signals stemming from the character generator but in such a way that the liquid developer is dispensed in a distribution pattern corresponding to a coarser version of the electrostatic image formed on layer 3 by the scanning-wise exposure. The coarser distribution pattern can e.g. be one resulting from the integration of four neighbouring digitized pixel values, and the deposition of overlapping drops, so that the -resolution of the distribution pattern is four times lower than of the said electrostatic image.

Next to the ink-jet device 7 follows optionally a light source 9 that overall illuminates the photoconductive layer 3 to a level sufficient to remove residual charge in the background area to prevent toner deposition thereon in the following air-jet cleaning.

Surplus liquid and toner particles not held electrostatically by the photoconductive layer 3 are removed with an air-jet by blowing pressurized air in the intake 10 of the venturi shaped passage 11 towards the outlet 12. The outlet 12 is connected to a vacuum pump. Upstream of the pump a filter withholds toner particles and a vapour trap, e.g. activated carbon captures vaporized carrier liquid.

The toner particle image left on photoconductive layer 3 is transferred under the influence of electrostatic charges of opposite polarity generated by transfer corona 13 to a receiving paper sheat 14. Individual paper sheets 14 are supplied from a sheet dispenser 15 and are conveyed by a series of conveyor rollers 16 towards a pivotable receiving tray 17.

The photoconductive layer 3 after transfer of the toner image is overall exposed to light source 18 to remove residual charges and is cleaned with web device 19 to remove residual toner.

Figure 2:
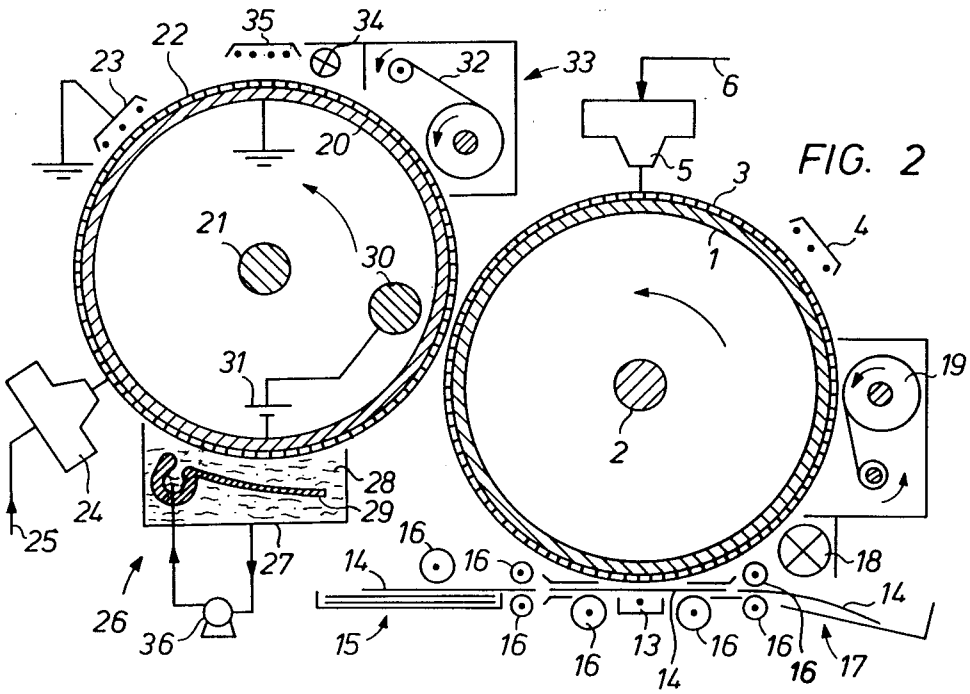
FIG. 2 is a similar view of an apparatus according to the present invention, wherein electrophoretic developer is initially applied in coarse image formation onto a photoconductive carrier.

The apparatus illustrated in FIG. 2 comprises a photoconductive carrier drum 20 which is arranged in close proximity to a drum 1 corresponding to drum 1 in FIG. 1.

In FIG. 2 the parts numbered 1, 2, 3, 4, 5, 6, 13, 14, 15, 16, 17, 18 and 19 are identical to the correspondingly numbered parts in FIG. 1.

The drum 20 is rotationally driven by its shaft 21. The drum comprises a conductive shell made e.g. from aluminium, which bears a photoconductive coating 22, e.g. made of vapour-deposited photoconductive selenium or solenium alloy. In a first step the photoconductive layer 22 is overall charged electrostatically with the direct current corona unit 23. Following the corona charging the photoconductive layer 22 is line-wise exposed by means of an array 24 of LED elements of which the light-output is controlled by digital signals fed to the array by input line 25 which is connected to the signal output of a character generator (not shown in the drawing). The LED array 24 irradiates the photoconductive layer in a pattern of spots of larger diameter than the spots irradiated on photoconductive layer 3. by the LED array 5. The electrostatic charge pattern thus formed on drum 20 corresponds with the electrostatic image formed on drum 1 but is of lower resolution.

In the tray developing device 26 electrophoretic developer liquid 27 is flowed through a passage 28 defined by a developing electrode 29 and the photoconductive layer 22 and developer is image-wise attracted to the drum to develop the electrostatic charge pattern thereon. The developing device is provided with a liquid recycling pump 36. Next to the developing device 26 follows inside the drum 20 a conductive bar 30 that is connected to a direct current voltage source 31 and thereby induces through the conductive material of the drum and the photoconductive layer 22 a charge at least partially neutralizing the electrostatic charges by which the toner particles are attracted to the drum 20. The charges forming the electrostatic image on photoconductive layer 3 provide the necessary electrical field strength to cause the toner particles to transfer, i.e. jump across the gap between the photoconductive layer 22 and the photoconductive layer 3 and to develop the said electrostatic image. The width of the gap is not very critical and may be in the range of 10 to 50 μm yielding a sharp development.

The peripheral speed of the drums 1 and 20 is the same but their motions at the location of the development zone i.e. at the toner transfer gap, are in opposite directions. The photoconductive layer 22 after said transfer of toner particles is cleaned with web 32 of cleaning device 33 to remove residual toner developer.

Residual charge on photoconductive layer 22 is removed by overall illumination with exposure source 34 and treatment with the ionizing flux of the alternating current corona 35.

Figure 3:
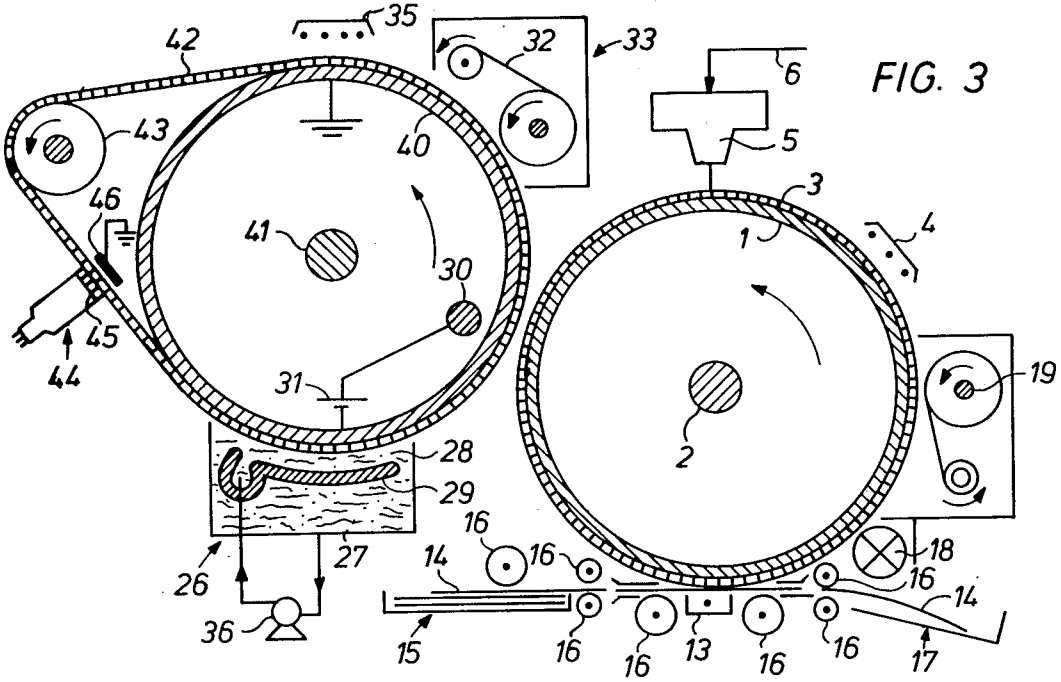
FIG. 3 is a similar view of an apparatus according to the present invention, wherein electrophoretic developer is initially applied in coarse image formation onto a dielectric carrier in the form of a belt.

The apparatus illustrated in FIG. 3 is similar to that shown in FIG. 2 except that a dielectric belt 42 carries the initially formed pattern of liquid developer to the development zone.

In FIG. 3 the parts 1, 2, 3, 4, 5, 6, 13, 14, 15, 16, 17, 18, 19, 26, 27, 28, 29, 30, 31, 32, 33, 35, and 36 are identical to the correspondingly numbered parts in FIG. 2.

The dielectric belt 42 is supported by a conductive drum 40 and a pulley 43. The drum is driven anti-clockwise by its shft 41. The drum 1 can e.g. be made of aluminium. The dielectric belt 42 can e.g. be formed by polyethylene-coated paper.

In a first stage of a copying cycle the belt 42 is pattern-wise charged with a cathode ray tube 44 having one or more rows of closely spaced fine wires 45 embedded in the face of the tube as described in the book "Electrophotography" by R. M. Schaffert, second revised edition, The Focal Press, London and New York, (1975). pp. 205–206. The belt 42 is sandwiched between the face of the tube 44 and a grounded electrode 46. The charge pattern thus formed on the belt corresponds with the electrostatic image formed on the surface of photoconductive layer 3 (which is the image to be developed) but is of a lower resolution The preliminary development by the development device 26, the transfer of liquid developer to the drum 1, and the operations of the cleaning web 32 nd the corona 35 take place in the same way as in the apparatus according to FIG. 2.

The peripheral speed of the drums 1 and 40 is the same but their motions at the location of the tone transfer gap are in opposite directions.

By way of modification of the system shown in FIG. 3, a dielectric web supplied from a spool can be used instead of an endless dielectric belt. In that case cleaning operations can be omitted because in each copying cycle a fresh frame of the web can be used.

According to another advantageous embodiment of the invention (not illustrated) an ink-jet dispenser can be used for dispensing liquid developer in the required relatively low resolution image pattern onto a dielectric member to form thereon the liquid developer pattern and this pattern can be progressively brought to the development zone for developing the higher resolution electrostatic image on the recording surface.

For example, the ink-jet device of the embodiment illustrated in FIG. 1 can be used to form a coarse liquid developer pattern on a dielectric carrier roller and the toner particles of that pattern can be transferred onto the electrostatic image of higher image resolution formed on the photoconductive drum 1 in that figure. This latter procedure has the advantage in comparison with tray development that a fresh portion of liquid developer is made available for the development in each copying cycle. So there is no need for toner replenishment. Changes in developer properties due to accumulation of dissolved charge controlling ions, as take place in tray development, do not take place. Moreover, since the liquid developer is supplied patternwise and does not wet the whole surface of the carrier roller, less carrier liquid has to be removed in the fixing step. Consequently there is less environmental pollution and a hydrocarbon carrier liquid for the toner particles can be used with practically no risk of fire.

In all the embodiments of the present invention operating with a photoconductive member the photoconductive layer and its conductive support may form a fixed part of a rotating drum or may be constructed by sheet material which is removably attached to a drum. Alternatively the photoconductive member can be in the form of a belt, e.g. an endless belt, that can be replaced.

I claim:

1. A method of developing an electrostatic image on a recording surface by supplying liquid developer comprising positively or negatively charged toner particles dispersed in an electrically insulating non-polar carrier liquid to a developing zone where increments of the electrostatic image are successively developed by attraction of toner particles to the recording surface in a distribution depending on the distribution of charges forming said electrostatic image, characterised in that the liquid developer is supplied to the developing zone so that in course of the period over which the development of the complete electrostatic image takes place, said developer is made available at that zone in a distribution pattern which constitutes a lower resolution version of the electrostatic image to be developed, each increment of said pattern being brought directly opposite the corresponding increment of the electrostatic image.

2. A method according to claim 1, wherein liquid developer is dispensed from one or more dispensing nozzles in the said distribution pattern.

3. A method according to claim 2, wherein said liquid developer is dispensed from one or more nozzles in dependence on sequential electrical signals dictated by digital information representing elementary parts (pixels) of the lower resolution version of the electrostatic image to be developed.

4. A method according to claim 3, wherein said electrical signals for controlling the dispensing of the liquid developer are derived by signal strength modulation in dependence on digital data resulting from an analog-to-digital conversion of signals obtained from a photodetector during a scanning operation wherein light reflected from or transmitted by a graphic original represented by the electrostatic image to be developed is received by such photodetector.

5. A method according to claim 3, wherein said control signals are derived by signal strength modulation in dependence on digital data stemming from a character generator coupled to a computer or word processor.

6. A method according to claim 2, wherein the dispensing of liquid developer from said nozzle(s) in the required distribution pattern is effected in accordance with a technique used in ink-jet printing.

7. A method according to claim 1, wherein liquid developer is made available at the development zone in the required distribution pattern by applying liquid developer to an insulating carrier surface in the distribution pattern in which it is to be made available at the development zone, and then bringing the resulting applied developer pattern progressively to the development zone for developing the higher resolution electrostatic image on the recording surface.

8. A method according to claim 7, wherein the said insulating carrier surface and the recording surface are surfaces of first and second photoconductive members on which an electrostatic charge pattern (corresponding with said required developer distribution pattern) and the required higher resolution electrostatic image are respectively formed, in each case by overall electrostatically charging the member and then exposing it to a light image of the appropriate resolution; the lower resolution electrostatic charge pattern is developed by means of the liquid developer thereby to form a corresponding pattern of liquid developer on said first photoconductive member; the first and second photoconductive members are displaced so as to bring such liquid developer pattern and the higher resolution electrostatic image progressively and in appropriate register to the development zone, and liquid developer is caused to transfer from the first to the second photoconductive member at that zone to develop the higher resolution electrostatic image.

9. A method according to claim 8, wherein instead of forming the lower resolution charge pattern on a photoconductive member, such charge pattern is formed on a dielectric non-photoconductive member by means of (an) image-wise modulated ion stream(s) or (a) charge-modulated conductor(s).

* * * * *